US011530859B2

(12) United States Patent
Miller et al.

(10) Patent No.: US 11,530,859 B2
(45) Date of Patent: Dec. 20, 2022

(54) ICE CRUSHING DEVICE

(71) Applicant: QINGDAO HAIER JOINT STOCK CO., LTD., Qingdao (CN)

(72) Inventors: Charles Miller, Qingdao (CN); Nick Gilkey, Qingdao (CN); Jianjun Xue, Qingdao (CN); Chuan Cui, Qingdao (CN)

(73) Assignee: QINGDAO HAIER JOINT STOCK CO., LTD., Qingdao (CN)

( * ) Notice: Subject to any disclaimer, the term of this patent is extended or adjusted under 35 U.S.C. 154(b) by 194 days.

(21) Appl. No.: 16/610,898

(22) PCT Filed: Apr. 25, 2018

(86) PCT No.: PCT/CN2018/084410

§ 371 (c)(1),
(2) Date: Nov. 4, 2019

(87) PCT Pub. No.: WO2018/201945

PCT Pub. Date: Nov. 8, 2018

(65) Prior Publication Data

US 2021/0148624 A1 May 20, 2021

(30) Foreign Application Priority Data

| | | |
|---|---|---|
| May 5, 2017 | (CN) | 201710312429.8 |
| Dec. 1, 2017 | (CN) | 201711250430.9 |
| Dec. 1, 2017 | (CN) | 201711252487.2 |
| Dec. 1, 2017 | (CN) | 201711252491.9 |
| Dec. 1, 2017 | (CN) | 201711252492.3 |

(51) Int. Cl.
*F25C 5/04* (2006.01)

(52) U.S. Cl.
CPC ..... *F25C 5/046* (2013.01)

(58) Field of Classification Search
CPC ..... F25C 5/046
USPC ..... 62/320
See application file for complete search history.

(56) References Cited

U.S. PATENT DOCUMENTS

| | | | | |
|---|---|---|---|---|
| 2,048,509 A * | 7/1936 | Melcher | F25C 5/043 D7/374 |
| 2,071,730 A * | 2/1937 | Coventry | A23G 9/045 241/243 |
| 2,123,827 A * | 7/1938 | Eyrick | F25C 5/046 241/266 |
| 2,234,273 A * | 3/1941 | Pennington | E21B 10/50 175/379 |

(Continued)

FOREIGN PATENT DOCUMENTS

| | | |
|---|---|---|
| CN | 1576760 A | 2/2005 |
| CN | 205279557 U | 6/2016 |

(Continued)

*Primary Examiner* — Eric S Ruppert
*Assistant Examiner* — Kirstin U Oswald
(74) *Attorney, Agent, or Firm* — Cheng-Ju Chiang

(57) ABSTRACT

The present invention provides an ice crushing device, of which a fixed ice cutter and a rotary ice cutter can cooperate to cut and process big ice cubes that enter a drum into small ice cubes. Besides, based on the operation mode that the drum rotates, the probability that crushed ice is adhered onto an inner wall of the drum can be effectively reduced. Thus, the frequency of cleaning the inner wall of the drum can be reduced.

18 Claims, 9 Drawing Sheets

(56) References Cited

U.S. PATENT DOCUMENTS 2,237,078 A * 4/1941 Lilly ..... F25C 5/046 241/242
2,264,049 A * 11/1941 Miller ..... F25C 5/046 241/243
2,337,161 A * 12/1943 Hessert ..... A23G 9/287 414/412
2,344,922 A * 3/1944 Raver ..... F25C 1/142 62/226
2,422,094 A * 6/1947 Hagaman ..... F25C 5/046 241/293
2,490,324 A * 12/1949 Rigby ..... F25C 1/145 62/320
2,610,803 A * 9/1952 Bayston ..... F25C 5/046 241/DIG. 17
2,648,203 A * 8/1953 Heuser ..... F25C 5/046 62/352
2,741,096 A * 4/1956 Fitzner ..... F25C 1/06 62/379
2,779,165 A * 1/1957 Pichler ..... F25C 5/00 141/105
2,803,410 A * 8/1957 Bodoni, Jr. ..... F25C 5/046 241/189.2
2,839,250 A * 6/1958 Brockman ..... F25C 5/046 241/36
2,905,398 A * 9/1959 De Angelis ..... F25C 5/046 241/257.1
3,034,311 A * 5/1962 Nelson ..... F25C 5/142 62/320
3,101,872 A * 8/1963 Dickinson ..... G07F 17/0071 222/242
3,126,719 A * 3/1964 Swatsick ..... F25C 1/147 62/320
3,159,986 A * 12/1964 King ..... F25C 1/14 62/320
3,238,740 A * 3/1966 Ross ..... F25C 1/142 62/320
3,256,710 A * 6/1966 Dedricks ..... F25C 1/147 62/320
3,354,666 A * 11/1967 Beusch ..... F25C 1/147 62/320
3,428,173 A * 2/1969 Heuser ..... F25C 5/00 62/320
3,602,441 A * 8/1971 Alvarez ..... F25C 5/02 62/320
3,630,045 A * 12/1971 Lunde ..... F25C 1/147 62/320
3,640,088 A * 2/1972 Jacobus ..... F25C 5/22 219/214
3,640,089 A * 2/1972 Frazier ..... H02M 1/083 62/320
3,654,770 A * 4/1972 Clearman ..... F25C 1/147 62/320
3,662,564 A * 5/1972 Clearman ..... F25C 1/147 62/320
3,803,869 A * 4/1974 Neumann ..... F25C 1/14 62/320
3,837,587 A * 9/1974 Walter ..... A47J 43/046 241/101.8
3,843,067 A * 10/1974 Prada ..... F25C 5/22 62/320
4,176,527 A * 12/1979 Linstromberg ..... F25C 5/046 62/320
4,276,750 A * 7/1981 Kawasumi ..... F25C 1/147 62/320
4,484,455 A * 11/1984 Hida ..... F25C 1/147 62/320
4,510,768 A * 4/1985 Keller ..... F25C 5/046 62/320
4,574,593 A * 3/1986 Nelson ..... F25C 1/147 62/320
4,576,016 A * 3/1986 Nelson ..... F25C 1/147 62/320
4,796,440 A * 1/1989 Shiotani ..... A23G 9/283 366/186
4,969,337 A * 11/1990 Hida ..... F25C 5/142 62/320
4,972,999 A * 11/1990 Grace ..... F25C 5/046 62/320
5,056,688 A * 10/1991 Goetz ..... F25C 5/046 222/413
5,109,679 A * 5/1992 Hida ..... F25C 5/142 62/320
5,125,242 A * 6/1992 von Blanquet ..... F25C 5/24 198/453
5,860,564 A * 1/1999 Jablonski ..... G07F 13/00 221/311
6,328,236 B1 * 12/2001 Upson ..... F25C 5/12 241/95
6,418,733 B1 * 7/2002 Morent ..... F25C 3/00 62/235
6,442,954 B1 * 9/2002 Shapiro ..... F25C 5/22 62/344
6,626,737 B1 * 9/2003 Ullens de Schooten ..... B24C 1/003 451/39
6,827,529 B1 * 12/2004 Berge ..... F25C 5/20 406/28
6,964,177 B2 * 11/2005 Lee ..... F25C 5/046 62/320
7,003,974 B1 * 2/2006 Brooks ..... F25C 1/147 62/320
7,111,473 B2 * 9/2006 Chung ..... F25C 5/046 62/320
7,278,275 B2 * 10/2007 Voglewede ..... F25C 5/22 62/320
7,360,377 B2 * 4/2008 Park ..... F25C 5/22 62/320
7,571,619 B2 * 8/2009 Park ..... F25C 5/12 62/320
7,748,230 B2 * 7/2010 An ..... F25C 5/12 62/320
7,992,407 B2 * 8/2011 Kim ..... F25C 5/046 62/320
8,794,023 B2 * 8/2014 Nuss ..... F25C 5/22 62/340
8,881,952 B1 * 11/2014 Dickson, Jr. ..... F25C 5/24 222/197
2005/0006406 A1 * 1/2005 Jablonski ..... F25C 5/24 222/146.6
2006/0059939 A1 * 3/2006 An ..... F25C 5/046 62/320
2006/0065007 A1 * 3/2006 Park ..... F25C 5/046 62/344
2006/0065008 A1 * 3/2006 Park ..... F25C 5/046 62/344
2006/0086127 A1 * 4/2006 Anselmino ..... F25C 5/22 62/340
2006/0169721 A1 * 8/2006 Hammonds ..... F25C 5/046 222/146.6
2006/0248912 A1 * 11/2006 Park ..... F25C 5/12 414/151
2008/0156017 A1 * 7/2008 Johnson ..... F25C 5/046 62/320
2008/0156826 A1 * 7/2008 Kim ..... F25C 5/22 221/253
2009/0133428 A1 * 5/2009 An ..... F25C 5/182 62/320
2009/0320511 A1 * 12/2009 Buchstab ..... F25C 5/22 62/320
2010/0024461 A1 * 2/2010 Buchstab ..... F25C 5/24 62/340
2010/0218538 A1 * 9/2010 Buchstab ..... F25C 5/046 62/320
2010/0313593 A1 * 12/2010 Lee ..... F25C 5/22 62/320
2011/0048052 A1 * 3/2011 Lee ..... F25C 5/046 62/320

(56) References Cited

U.S. PATENT DOCUMENTS

| | | | | |
|---|---|---|---|---|
| 2011/0100046 | A1* | 5/2011 | Choi | F25D 23/069 62/320 |
| 2011/0120152 | A1* | 5/2011 | Talegaonkar | F25C 5/046 62/320 |
| 2012/0047938 | A1* | 3/2012 | Ku | F25C 5/12 62/320 |
| 2013/0042644 | A1* | 2/2013 | Mitchell | F25C 5/20 62/320 |
| 2013/0104587 | A1* | 5/2013 | Nuss | F25C 5/046 62/320 |
| 2013/0105611 | A1* | 5/2013 | Nuss | F25C 5/046 241/277 |
| 2013/0305763 | A1* | 11/2013 | Nuss | F25C 5/12 62/320 |
| 2015/0135739 | A1* | 5/2015 | Choo | F25C 5/02 62/320 |
| 2017/0234594 | A1* | 8/2017 | Mitchell | F25C 1/147 62/342 |
| 2017/0363340 | A1* | 12/2017 | Li | F25C 5/046 |

FOREIGN PATENT DOCUMENTS

| | | | |
|---|---|---|---|
| CN | 107014127 | A | 8/2017 |
| CN | 107940850 | A | 4/2018 |
| JP | H8-86548 | A | 4/1996 |
| KR | 10-0525416 | B1 | 11/2005 |

* cited by examiner

ICE CRUSHING DEVICE

The present application is a 35 U.S.C. § 371 National Phase conversion of International (PCT) Patent Application No. PCT/CN2018/084410, filed on Apr. 25, 2018, which claims the priority of the following Chinese patent applications: 1. Application No. 201710312429.8, filed on May 5, 2017, and entitled "ice-breaking device"; 2. Application No. 201711252492.3, filed on Dec. 1, 2017, and entitled "blocking prevention ice breaking device"; 3. Application No. 201711252491.9, filed on Dec. 1, 2017, and entitled "ice crushing device"; 4. Application No. 201711252487.2, filed on Dec. 1, 2017, and entitled "ice smashing device"; 5. Application No. 201711250430.9, filed on Dec. 1, 2017, and entitled "ice breaking system", the content of which is incorporated herein by reference in its entirety. The PCT International Patent Application was filed and published in Chinese.

TECHNICAL FIELD

The present invention relates to the field of ice making and in particular to an ice crushing device capable of processing a whole big piece of ice into small crushed ice.

BACKGROUND

With increasing improvement of people's living standards, people's pursuit to the quality of life is getting higher and higher. As an import tool to facilitate user's life, a refrigerator has received more and more attention to its other functions in addition to refrigerating and freezing features, for example, an ice-making function. Traditionally, the refrigerator achieves ice making by disposing an ice-making box with grids in certain regular shapes inside a freezing chamber. After ice making, the only requirement is to pour ice cubes out of the ice-making box. The made ice cubes are in the same shapes as the grids, However, this traditional ice-making method arouses the following problem: the ice-making box generally has a relatively limited ice-making capacity, and thus, cannot meet the user's demand for lots of ice cubes.

In view of this, technical studies on disposing an ice maker inside the refrigerator have begun to be conducted in the industry. Original ice cubes made by the ice maker are generally larger in size, and in many cases, cannot be directly used. Thus, it is necessary to provide a technical means capable of processing the big ice cubes into small ice cubes to solve the above-mentioned problem.

SUMMARY

Aiming at fulfilling the objective of processing a big ice cube into small ice cubes, the present invention provides an ice crushing device, which particularly adopts the following design.

An ice crushing device, comprising a shaft seat with an ice outlet formed in the bottom, a fixed shaft fixedly disposed on the shaft seat and a drum rotationally disposed on the shaft seat by taking the fixed shaft as a rotation axis, wherein an ice cutter component is disposed inside the drum, and comprises at least one fixed ice cutter secured to the fixed shaft and at least one rotary ice cutter secured to an inner wall of the drum and capable of rotating with the drum; the rotary ice cutter has a first rotation direction for rotation relative to the fixed ice cutter to cut a whole piece of ice in the drum into crushed ice; the ice outlet is located at one side of the fixed shaft and provided with a crushed-ice discharge side for discharging the crushed ice; when rotating in the first rotation direction, the rotary ice cutter enters a space at an upper portion of the ice outlet from a position right above the crushed-ice discharge side of the ice outlet; the fixed ice cutter is located in a space at the upper portion of the ice outlet and provided with a cutter edge side for cutting the whole piece of ice; and the cutter edge side of the fixed ice cutter faces the crushed-ice discharge side.

Optionally, wherein the rotary ice cutter further has a second rotation direction, which is opposite to the first rotation direction and allows the whole piece of ice to be directly pushed into the ice outlet; the ice outlet is provided with a whole-piece-of-ice discharge side; when rotating in the second rotation direction, the rotary ice cutter enters the space at the upper portion of the ice outlet from a position right above the whole-piece-of-ice discharge side of the ice outlet; and a distance between a side, away from the cutter edge side, of the fixed ice cutter and the whole-piece-of-ice discharge side is larger than the size of the whole piece of ice.

Optionally, wherein the ice outlet takes the shape of a sector, the center of a circle where the sector is located is positioned at the fixed shaft, and the crushed-ice discharge side and the whole-piece-of-ice discharge side respectively constitute two radiuses of a central angle of the sector.

Optionally, wherein the rotary ice cutter and the fixed ice cutter which constitute the ice cutter component are staggered along the fixed shaft from top to bottom.

Optionally, wherein one fixed ice cutter is disposed at a lowermost end of the ice cutter component, and a distance between the cutter edge side of the fixed ice cutter at the lowermost end and the crushed-ice discharge side is smaller than the size of the whole piece of ice.

Optionally, wherein the ice cutter component is provided with at least two fixed ice cutters, all the fixed ice cutters are laminated and spaced in a vertical direction, and a distance between the two adjacent fixed ice cutters in the vertical direction is smaller than the size of the whole piece of ice.

Optionally, wherein an ice-incoming baffle plate is disposed at the top of the drum, secured to the fixed shaft and provided with an ice inlet that allows the whole piece of ice at the top of the drum to enter the drum, the ice inlet is located at one side of the fixed shaft, and the ice inlet and the ice outlet are mutually staggered in the first rotation direction.

Optionally, wherein in the first rotation direction, a front side edge and a rear side edge of the ice inlet are designed into saw-toothed structures.

Optionally, wherein one rotary ice cutter is disposed at an uppermost layer of the ice cutter component.

Optionally, wherein the size of an overlap of projections of the ice inlet and the ice outlet in a vertical direction is smaller than the size of the whole piece of ice.

Optionally, wherein the rotary ice cutter is provided with a cutter edge side for cutting the whole piece of ice; in the first rotation direction, the cutter edge side of the rotary ice cutter is located on the front side; and when the rotary ice cutter rotates in the first rotation direction, the cutter edge sides of the rotary ice cutter and the fixed ice cutter perform a cutting motion relative to each other.

Optionally, wherein the cutter edge sides of the rotary ice cutter and the fixed ice cutter are designed into saw-toothed structures.

Optionally, wherein a first rotation hole is formed in the rotary ice cutter, the rotary ice cutter is rotationally disposed on the fixed shaft through the first rotation hole, and two ends of the rotary ice cutter are secured to the inner wall of the drum.

Optionally, the ice crushing device further provided with an ice exiting channel located below the ice outlet, wherein the ice exiting channel comprises a funneled ice receiving portion and a pipeline portion communicated with a lower end of the ice receiving portion; a channel inlet butted with the ice outlet is formed in a top end of the ice receiving portion; the lower end of the ice receiving portion spirally extends downwards to form the pipeline portion; a tangent line of a spiral trend line in the center of the pipeline portion at a joint of the ice receiving portion and the pipeline portion and a plane where the channel inlet is located intersect at a first side in the center of the channel inlet; and a projection of a geometric gravity center of the ice outlet on the plane where the channel inlet is located falls within the range of the channel inlet and is shifted toward the first side.

The ice crushing device provided by the present invention has the following beneficial effects: since a fixed ice cutter and a rotary ice cutter are disposed inside a drum and can cooperate to cut and process big ice cubes entering the drum into small ice cubes; and based on the running mode that the drum rotates, the probability that the crushed ice is adhered onto the inner wall of the drum can be effectively lowered, and the frequency of cleaning the inner wall of the drum is reduced.

DETAILED DESCRIPTION

The present invention will be described in detail below with reference to all embodiments shown in the accompanying drawings. Referring to FIGS. 1 to 16, which are some preferred embodiments of the present invention.

With reference to FIGS. 1, 2, 3 and 4, an ice crushing device provided by the present invention includes a shaft seat 1, a fixed shaft 2, a drum 3 and a power transmission component 4. The fixed shaft 2 is secured to the shaft seat 1. The drum 3 is rotationally disposed on the shaft seat 1 by taking the fixed shaft 2 as a rotation axis. The power transmission component 4 provides power for the drum 3 to rotate.

Figure 3:
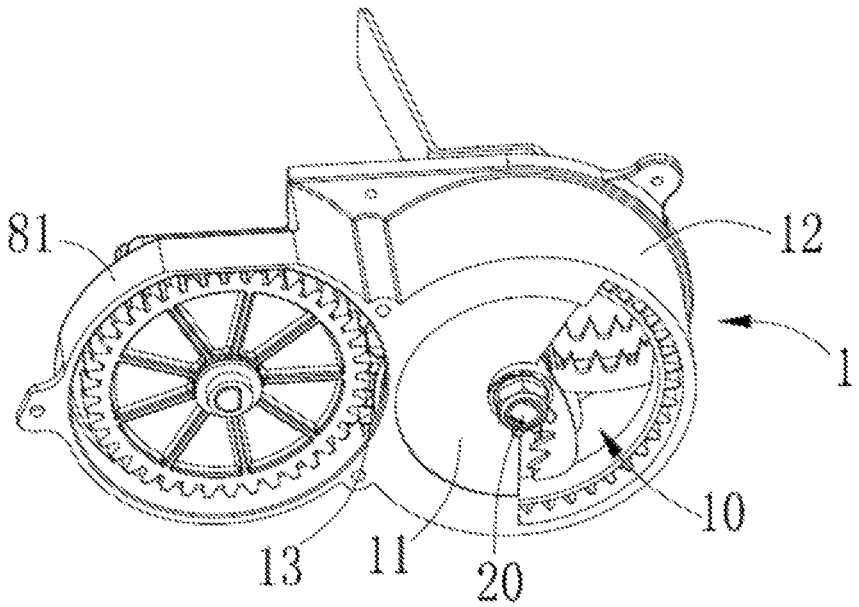
FIG. 3 is a schematic view of cooperation at the bottom of the ice crushing device.

More particularly, in the present specific embodiment, the shaft seat 1 includes a shaft seat bottom 11 disposed at the bottom of the shaft seat 1 and a drum shell 12 extending upwards from a periphery of the shaft seat bottom 11. The drum 3 is embedded into the drum shell 12. The drum shell 12 is disposed to protect the rotating drum 3 and can avoid unnecessary potential safety hazards caused by rotation of the drum 3. Certainly, it should be understood that in some simplified embodiments, the shaft seat 1 may only include the shaft seat bottom 11. That is, there is no protective shell at the periphery of the drum 3. The fixed shaft 2 is fixedly disposed on the shaft seat bottom 11. Referring to FIG. 3, a fixed end 20 of the fixed shaft 2 passes through the shaft seat bottom 11 and is locked and secured by screws. Certainly, in some other embodiments, the fixed shaft 2 may also be secured to the shaft seat bottom 11 by other means.

Figure 4:
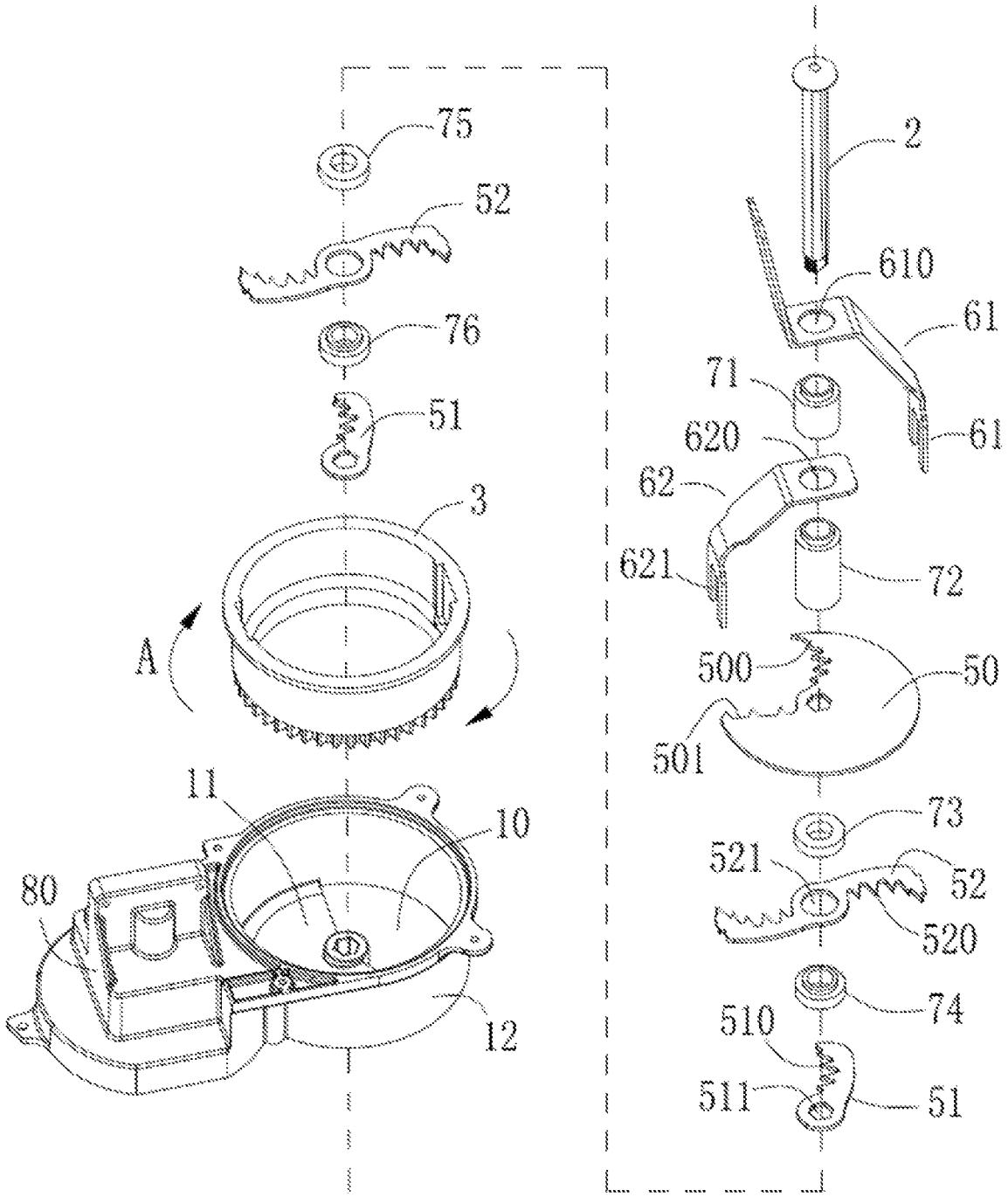
FIG. 4 is a schematic exploded view of partial disassembly of the ice crushing device.
Figure 5:
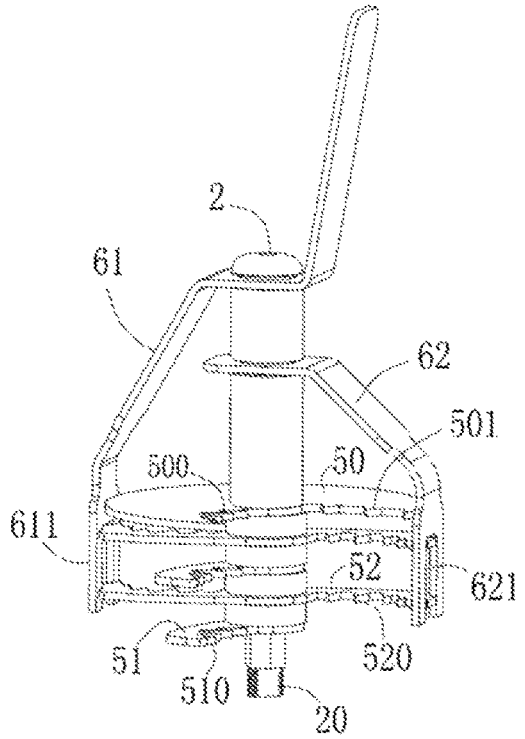
FIG. 5 is a schematic view of cooperation of a fixed ice cutter and a rotary ice cutter.
Figure 6:
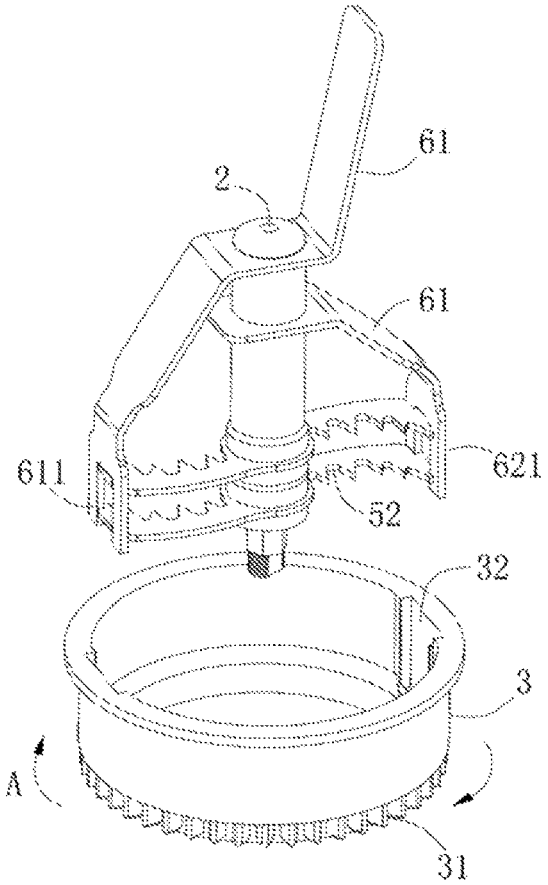
FIG. 6 is a schematic view of cooperation of the rotary ice cutter and a drum.

With reference to FIG. 4, FIG. 5 and FIG. 6, an ice cutter component is disposed inside the drum 3 of the ice crushing device and includes at least one fixed ice cutter 51 secured to the fixed shaft 2 and at least one rotary ice cutter 52 secured to an inner wall of the drum 3 and capable of rotating with the drum 3. The drum 3 has a first rotation direction A for cutting ice cubes. When the drum 3 rotates in the first rotation direction A, the rotary ice cutter 52 performs a cutting motion relative to the fixed ice cutter 51 to cut a whole piece of ice in the drum 3 into crushed ice.

In particular, in the present embodiment, a section of the fixed shaft 2 may be non-circular, for example, it may be hexagonal or in other shapes. A fixing hole 511 that matches the shape of the section of the fixed shaft 2 is formed in one end of the fixed ice cutter 51. The end with the fixing hole 511 is a fixed end of the fixed ice cutter 51. The fixed ice cutter 51 is sleeved on the fixed shaft 2 through the fixing hole 511 and secured to a specific location on the fixed shaft 2. The fixed ice cutter 51 is provided with a blade portion for cutting the whole piece of ice. The fixed end extends toward the inner wall of one side of the drum 3 to form the blade portion. The fixed ice cutter 51 involved in the present invention is only formed on one side of the fixed shaft 2. The fixed ice cutter 51 is disposed in the above way to achieve the following advantage: once the fixed ice cutter 51 is damaged, maintenance can be quickly realized through replacement. Certainly, in other embodiments, the fixed ice cutter 51 may be secured to a specific location on the fixed shaft 2 by means of welding or by other mechanical securing means.

In the present embodiment, a first rotation hole 521 is formed in the rotary ice cutter 52. The rotary ice cutter 52 is rotationally disposed on the fixed shaft 2 through the first rotation hole 521. Two ends of the rotary ice cutter 52 are secured to the inner wall of the drum 3. In particular, during implementation, a groove structure configured to secure the two ends of the rotary ice cutter 52 is disposed on the drum 3. The two ends of the rotary ice cutter 52 are embedded into the groove structure to be fixedly connected to the drum 3. Certainly, in some other embodiments, the rotary ice cutter 52 may also be indirectly secured to the inside of the drum 3. Referring to the following description for one specific implementation mode.

Referring to FIG. 5, in the drum 3, the fixed ice cutter 51 and the rotary ice cutter 52 are staggered from top to bottom. In particular, in the present embodiment, two fixed ice cutters 51 and two rotary ice cutters 52 are disposed inside the drum 3. From top to bottom, one rotary ice cutter 52, one fixed ice cutter 51, the other rotary ice cutter 52 and the other fixed ice cutter 51 are sequentially alternately disposed in parallel. As a preferred implementation mode of the present invention, all the fixed ice cutters 51 that constitute the ice cutter component are laminated and spaced in a vertical direction, and all the rotary ice cutters 52 may also adopt this design for reference.

During specific implementation, a user generally has certain demands on the sizes of crushed ice inside the drum 3. Based on this, a specific distance is kept between horizontal planes on which the fixed ice cutters 51 and the rotary ice cutters 52 are mutually staggered. During implementation of the present embodiment, distances between laminations of the fixed ice cutters 51 and the rotary ice cutters 52 are smaller than the size of the whole piece of ice but larger than the size of the crushed ice. Thus, the whole piece of ice that is not crushed is prevented from being directly pushed out from a gap between the two adjacent fixed ice cutters 51. More particularly, gaskets 74, 75 and 76 configured to isolate the fixed ice cutters 51 from the rotary ice cutters 52 are disposed between the fixed ice cutters 51 and the rotary ice cutters 52. The rotary ice cutters 52 may be sleeved at the peripheries of the gaskets and rotate around the gaskets.

Figure 2:
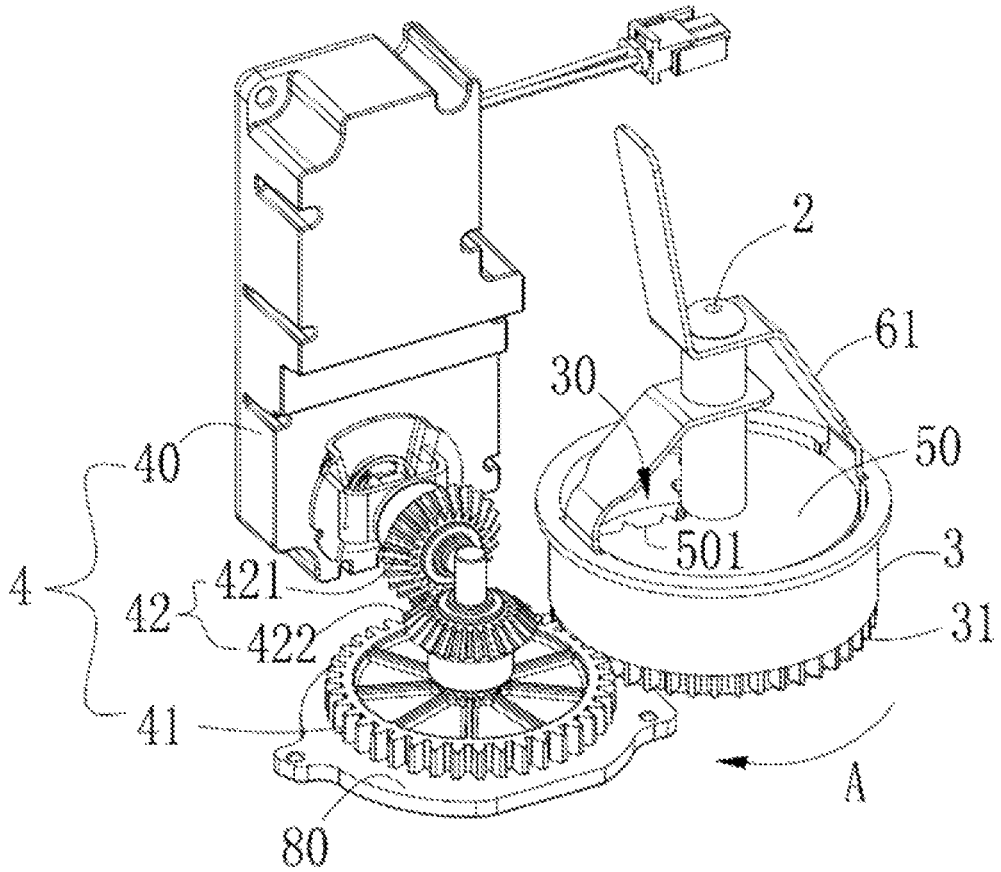
FIG. 2 is a schematic structural view of the ice crushing device with a gear housing and a drum shell removed.

Referring to FIG. 2 and FIG. 3, an ice inlet 30 for ice cubes to enter is formed in the top of the drum 3 in the ice crushing device. An ice outlet 10 for the ice cubes to be discharged is formed in the bottom of the shaft seat 1. The ice inlet 30 and the ice outlet 10 are mutually staggered in the first rotation direction A.

In particular, an ice-incoming baffle plate 50 is disposed at the upper part of the drum 3 and fixedly disposed on the fixed shaft 2. Referring to the disposing mode of the fixed ice cutter 51 for the specific fixing mode of the ice-incoming baffle plate 50. A gasket 73 for isolation is disposed between the ice-incoming baffle plate 50 and the adjacent fixed ice cutter 51 or rotary ice cutter 52 below. In the present specific embodiment, an opening substantially taking the shape of a sector is formed in the ice-incoming baffle plate 50. The sector-shaped opening constitutes the ice inlet 30 located at one side of the fixed shaft 2. The whole piece of ice to be processed at the top of the drum 3 enters the drum 3 through the ice inlet 30. An opening substantially taking the shape of a sector is also formed in the shaft seat bottom 11 and constitutes the ice outlet 10. The crushed ice processed by the fixed ice cutter 51 and the rotary ice cutter 52 is discharged through the ice outlet 10. In some other designs of the present invention, the ice inlet 30 and the ice outlet 10 may be designed into other shapes, not limited to sector structures.

In the present invention, in order to prevent the ice cubes that enter the drum 3 through the ice inlet 30 from being directly discharged from the ice outlet 10, the ice inlet 30 and the ice outlet 10 are mutually staggered in the first rotation direction A. Preferably, the ice outlet 10 is located at one side of the fixed shaft 2.

Figure 8:
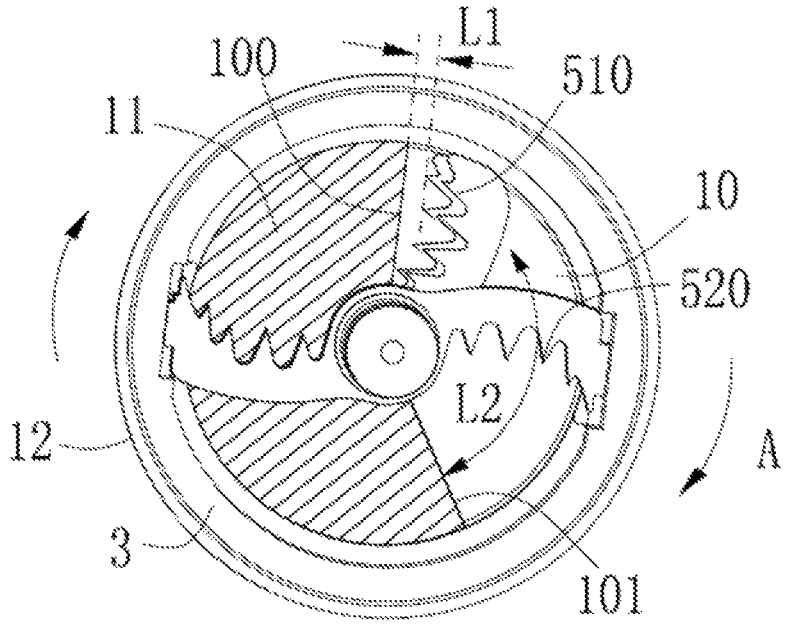
FIG. 8 is a top view of the internal structure of the drum.
Figure 9:
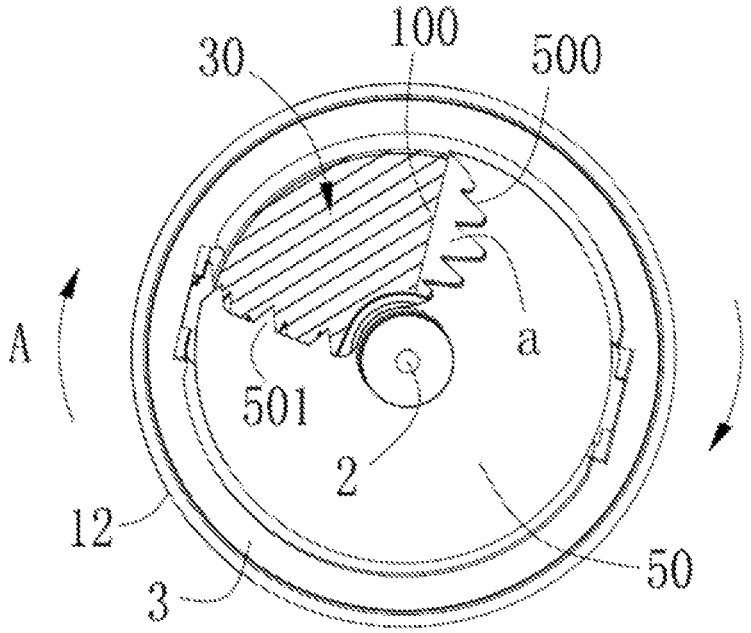
FIG. 9 is a top view of an ice-incoming baffle plate disposed on the upper side of the drum.

During specific implementation, the size of an overlap of projections of the ice inlet 30 and the ice outlet 10 in the vertical direction is smaller than that of the whole piece of ice. With reference to FIG. 8 and FIG. 9, in the present embodiment, the projections in the vertical direction of the ice inlet 30 and the ice outlet 10 which are mutually staggered have the overlap a of which the size is smaller than that of the whole piece of ice, such that the whole piece of ice that enters through the ice inlet 30 is prevented from directly falling into the ice outlet 10 and being discharged. Understandably, in other embodiments of the present invention, the projections in the vertical direction of the ice inlet 30 and the ice outlet 10 which are mutually staggered are non-overlapping (it can be understood that the size of the overlap a is 0). At this time, the whole piece of ice that enters through the ice inlet 30 cannot directly fall into the ice outlet 10, either.

Figure 7:
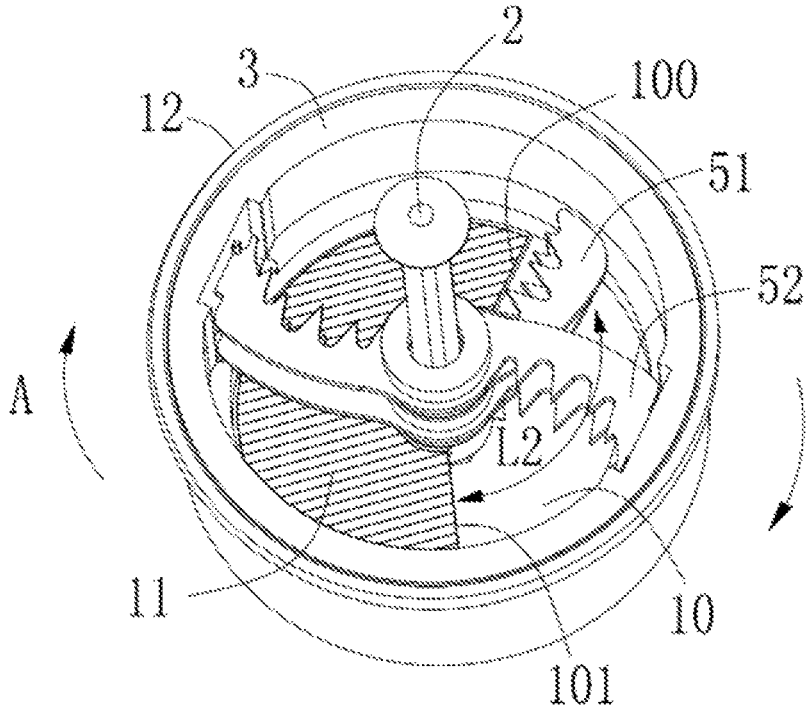
FIG. 7 is a schematic perspective view of the internal structure of the drum.

In the present invention, each of the fixed ice cutter 51 and the rotary ice cutter 52 is provided with a cutter edge side for cutting the ice cubes. When the drum rotates in the first rotation direction A to cut the ice cubes, the cutter edge sides of the rotary ice cutter 52 and the fixed ice cutter 51 co-extrude the ice cubes. With reference to FIG. 7 and FIG. 8, the fixed ice cutter 51 is provided with a first cutter edge side 510, and the rotary ice cutter 52 is provided with a second cutter edge side 520. In the present specific embodiment, the first cutter edge side 510 and the second cutter edge side 520 are designed into saw-toothed structures. In the first rotation direction A, the first cutter edge side 510 and the second cutter edge side 520 are disposed in opposite directions. In particular, in the first rotation direction A, the first cutter edge side 510 is disposed on the rear side of the fixed ice cutter 51, and the second cutter edge side 520 is disposed on the front side of the rotary ice cutter 52 (the rotary ice cutter 52 is provided with two blade structures at two sides of the first rotation hole 521, and cutter edge sides of the two blade structures are in axial symmetry). In this way, the first cutter edge side 510 and the second cutter edge side 520 cut the ice cubes together. In some other embodiments of the present invention, the first cutter edge side 510 and the second cutter edge side 520 may be designed into cutter-shaped structures with cutter points or into other structures.

In the present invention, referring to FIG. 7 and FIG. 8, the ice outlet 10 is provided with a crushed-ice discharge side 100. When the drum 3 rotates in the first rotation direction A, the rotary ice cutter 52 enters a space at the upper portion of the ice outlet 10 from a position directly above the crushed-ice discharge side 100. The fixed ice cutter 51 is disposed right above the crushed-ice discharge side 100 or near the top of the crushed-ice discharge side 100.

In one embodiment of the present invention, the fixed ice cutter 51 is disposed near the top of the crushed-ice discharge side 100. As a preferred mode of the present embodiment, with reference to FIG. 5, FIG. 7 and FIG. 8, the fixed ice cutter 51 is located in the space at the upper portion of the ice outlet 10. At this time, the first cutter edge side 510 of the fixed ice cutter 51 faces the crushed-ice discharge side 100. In order to prevent the whole piece of ice inside the drum 3 from being directly discharged from the crushed-ice discharge side 100 of the ice outlet 10, in the present embodiment, one fixed ice cutter 51 is disposed at the lowermost end of the ice cutter component. A distance L1 between the cutter edge side 510 of the fixed ice cutter 51 at the lowermost end and the crushed-ice discharge side 100 is smaller than the size of the whole piece of ice. Based on the preferred implementation mode of the present invention, the crushed ice processed by the ice cutter component can be quickly discharged from the ice outlet to avoid accumulative caking in the drum 3, and the whole piece of ice cannot be discharged from the crushed-ice discharge side 100.

In particular, referring to FIG. 7 and FIG. 8, in the first rotation direction A, the crushed-ice discharge side 100 is disposed at a rear side edge of the ice outlet 10. During ice crushing, the drum 3 drives the rotary ice cutter 52 to rotate and to cut and process the whole piece of ice together with the fixed ice cutter 51. The crushed ice enters the ice outlet 10 through the crushed-ice discharge side 100 to be discharged.

The drum 3 and the rotary ice cutter 52 in the present invention further have a second rotation direction (not shown) opposite to the first rotation direction A. Based on the above designed structure of the present invention, when the drum 3 rotates in the second rotation direction, the side, away from the second cutter edge side 520, of the rotary ice cutter 52 directly pushes the whole piece of ice that enters the drum 3 through the ice inlet 30 into the ice outlet 10 to directly discharge the whole big piece of ice. In particular, referring to FIG. 7 and FIG. 8, the ice outlet 10 is provided with a whole-piece-of-ice discharge side 101. When the drum 3 drives the rotary ice cutter 52 to rotate in the second rotation direction, the rotary ice cutter 52 enters the space at the upper portion of the ice outlet 10 from the position directly above the whole-piece-of-ice discharge side 101 of the ice outlet 10. A distance L2 between the side, away from the cutter edge side 510, of the fixed ice cutter 51 and the whole-piece-of-ice discharge side 101 is larger than the size of the whole piece of ice. Thus, the whole piece of ice can be discharged.

In the embodiment shown in FIG. 3, FIG. 7 and FIG. 8, in which the ice outlet 10 is a sector-shaped opening, the center of a circle where the sector is located is positioned at the fixed shaft 2. The crushed-ice discharge side 100 and the whole-piece-of-ice discharge side 101 respectively constitute two radiuses of the central angle of the sector.

In a preferred embodiment of the present invention, in order to enable the whole piece of ice that enters through the ice inlet 30 to be quickly crushed by the ice cutter component and to be discharged, the ice inlet 30 is disposed close to the crushed-ice discharge side 100 in the first rotation direction A. In particular, with reference to FIG. 8 and FIG. 9, a projection of the ice inlet 30 on the shaft seat bottom 11 at the bottom of the shaft seat 1 covers the crushed-ice discharge side 100 of the ice outlet 10. In this embodiment, the whole piece of ice that enters through the ice inlet 30 falls near the crushed-ice discharge side 100 and is crushed by the ice cutter component, and the crushed ice can be quickly discharged from the ice outlet 10. Certainly, it can be understood that in other embodiments of the present invention, the projection of the ice inlet 30 on the shaft seat bottom 11 at the bottom of the shaft seat 1 is only close to but not covers the crushed-ice discharge side 100 (not shown) of the ice outlet 10. From another perspective, in the present embodiment, the position of the front side edge 500 of the ice inlet 30 and the position of the rear side edge (namely, the crushed-ice discharge side 100) of the ice outlet 10 substantially overlap in the first rotation direction A.

In the above-mentioned preferred embodiment, the front side edge 500 of the ice inlet 30 is designed into a structure with a cutting function, and referring to the first cutter edge side 510 of the fixed ice cutter 51 for its specific structure. During specific implementation, the positions of the front side edge 500 of the ice inlet 30 and the first cutter edge side 510 of the fixed ice cutter 51 substantially coincide in the vertical direction. In the present embodiment, the ice-incoming baffle plate 50 can function as the fixed ice cutters while defining the ice inlet 30. Certainly, in some other embodiments, the ice inlet 30 on the ice-incoming baffle plate 50 can only allow ice to enter but not cut the ice cubes.

In some other more preferred embodiments, in the first rotation direction A, the front side edge 500 and the rear side edge 501 of the ice inlet 30 are designed into saw-toothed structures. Based on this setting, when the drum 3 rotates in the first rotation direction A, the saw-toothed structure of the front side edge 500 can function as the fixed ice cutters and assist the ice cutter component in cutting the whole piece of ice into the crushed ice. When the drum 3 rotates in the second rotation direction, and the whole piece of ice is pushed out from the whole-piece-of-ice discharge side 101 of the ice outlet 10 by a back side of the rotary ice cutter 52, the whole piece of ice may be clamped between the rear side edge 501 and the back side of the rotary ice cutter 52. If the rear side edge 501 is designed into a saw-toothed structure, it can quickly crush the clamped ice cubes. Thus, the whole piece of ice is discharged successfully, effectively solving the problem of unsmooth discharge of the whole piece of ice, caused when the drum rotates in the second rotation direction.

Since the front side edge 500 of the ice inlet 30 in the present embodiment can act as the fixed ice cutters, during operation of the ice crushing device, the rotary ice cutter 52 is disposed between the ice-incoming baffle plate 50 and the fixed ice cutter 51 at the uppermost layer. That is, one rotary ice cutter 51 is disposed at the uppermost layer of the ice cutter component. Owing to this design, the ice cube cutting function of the front side edge 500 of the ice inlet 30 can be effectively utilized.

During actual application, an ice storage box (not shown) for providing big ice cubes is generally disposed above the drum 3. During specific implementation, an ice stirring mechanism that rotates synchronously with the drum 3 to stir the ice cubes at the top of the drum 3 is disposed at the top of the drum 3. In particular, the ice stirring mechanism is configured to stir the ice cubes in the ice storage box so as to guide them into the ice inlet 30 at the top of the drum 3.

In a specific design, the ice stirring mechanism includes a plurality of ice stirring pieces, each of which is provided with a fixed portion secured to the drum and a second rotation hole for rotation around the fixed shaft 2. With reference to FIG. 4, FIG. 5 and FIG. 6, the ice stirring mechanism in the present embodiment includes two ice stirring pieces, namely, a first ice stirring piece 61 and a second ice stirring piece 62 on which fixed portions 611 and 621 secured to the drum and second rotation holes 610 and 620 for rotation around the fixed shaft 2 are respectively disposed.

During specific implementation, referring to FIG. 6, clamping grooves (not shown) are formed in the fixed portion 611 and 621 of the first ice stirring piece 61 and the second ice stirring piece 62 respectively. Two end portions of the rotary ice cutter 52 are clamped in the clamping grooves of the fixed portions 611 and 621. Two grooves 32 are oppositely formed in the inner wall of the drum 3. The two fixed portions 611 and 621 are respectively embedded into the two grooves 32 and realize fixation of the rotary ice cutter 52 to the drum 3. The two second rotation holes 610 and 620 of the ice stirring piece are rotationally sleeved on the fixed shaft 2. On the fixed shaft 2, a gasket 71 is disposed between the two ice stirring pieces. The ice-incoming baffle plate 50 and the ice stirring piece above are also provided with gaskets 72. In the present embodiment, the specific shapes and structures of the two ice stirring pieces match the internal structure of the ice storage box. Referring to FIG. 6, a pick (not marked) that warps is disposed at the end, away from the fixed portion 611, of the first ice stirring piece 61.

In the present embodiment, the rotation of the drum 3 is realized by power output of a motor 40. Referring to FIG. 2, in order to realize rotation of the drum 3, a round of engaging teeth 31 are formed in a peripheral side wall of the drum 3. The power transmission component 4 is provided with a direct-driven gear 41 that engages with the engaging teeth 31 to drive the drum 3 to rotate. In the present embodiment, the engaging teeth 31 are formed at the lowermost end edge of an outer wall of the drum 3. In some other embodiments, the engaging teeth 31 may also be formed in the middle or other positions (not shown) of the outer wall of the drum 3.

In the present embodiment, a gear component 42 constituted of a plurality of gears is further disposed between the motor 40 and the direct-driven gear 41. The motor 40 drives the direct-driven gear to rotate through the gear component 42. In particular, the gear component 42 in the present embodiment includes a first bevel gear 421 and a second bevel gear 422 that engage with and match each other. The first bevel gear 421 is directly driven by an output shaft of the motor 40. The second bevel gear 422 and the direct-driven gear 41 are disposed on the same rotating shaft. When the motor 40 works, the output shaft of the motor 40 drives the first bevel gear 421 to rotate. The first bevel gear 421 drives the second bevel gear 422 to rotate. The second bevel gear 422 drives the direct-driven gear 41 on the same rotating shaft to rotate. The direct-driven gear 41 cooperates with the engaging teeth 31 to cut the ice cubes inside the drum 3.

In some other embodiments, the direct-driven gear 41 may also be directly driven by the motor 40, or the drum 3 is directly driven by the motor 40 (not shown).

Figure 1:
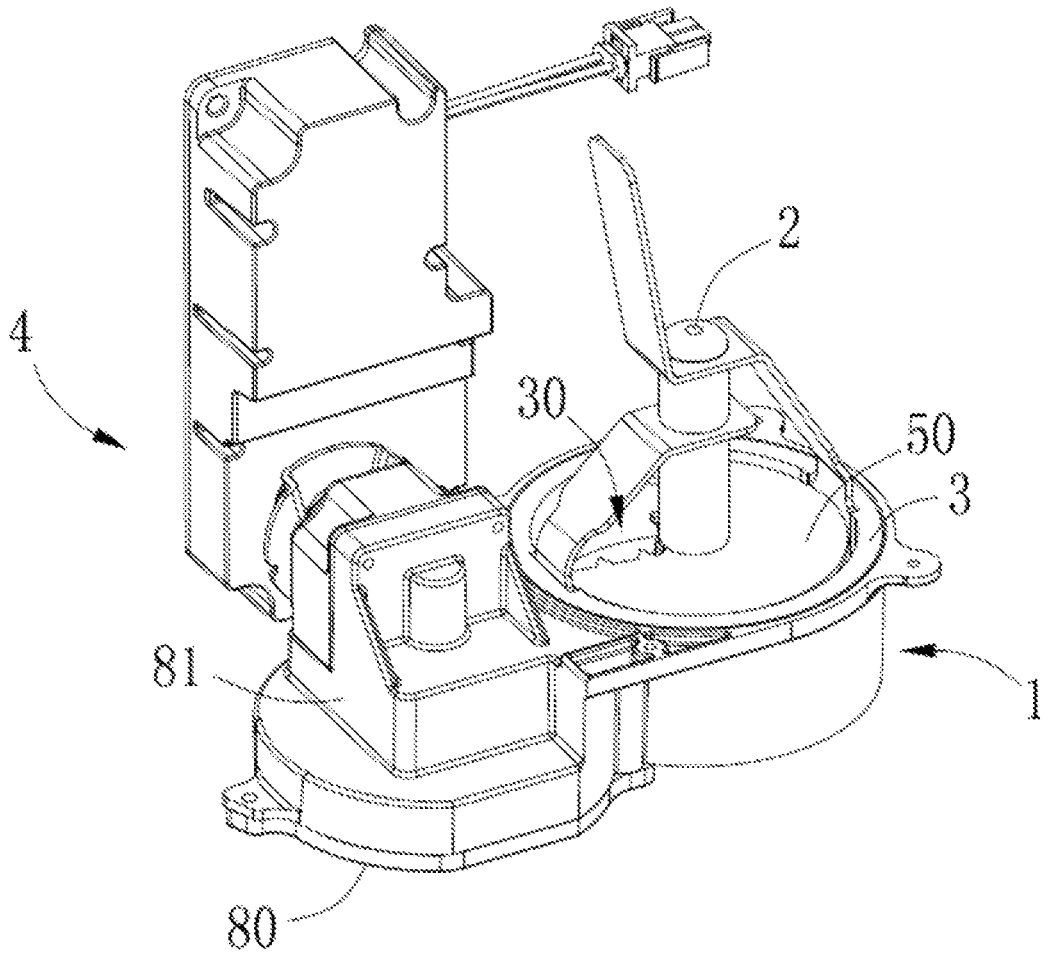
FIG. 1 is an overall schematic structural view of an ice crushing device according to one embodiment of the present invention.

With reference to FIG. 1, FIG. 2 and FIG. 3, the direct-driven gear 41 in the present embodiment is secured to a rotating shaft base 80 through the rotating shaft (not shown). A gear housing 81 configured to encapsulate the direct-driven gear 41 and the gear component 42 is disposed on the rotating shaft base 80. Owing to the gear housing 81, the ice crushing device has better security. Referring to FIG. 3, a notch 13 that allows the direct-driven gear 41 to cooperate with the engaging teeth 31 is formed between the gear housing 81 and the drum shell 12. In some specific implementation processes, the gear housing 81 and the drum shell 12 may be integrally formed such that the ice crushing device becomes modularized to be more conveniently mounted on other devices, for example, a refrigerator.

It should be noted herein that power of the drum is transferred by means of the motor and the gear, such that change of the direction can be easily realized during power transmission. Thus, the designed ice crushing device has a reasonable spatial structure. In some embodiments of the present invention, the drum 3 may rotate by means of a chain, a conveyor belt, etc. (not shown).

Figure 10:
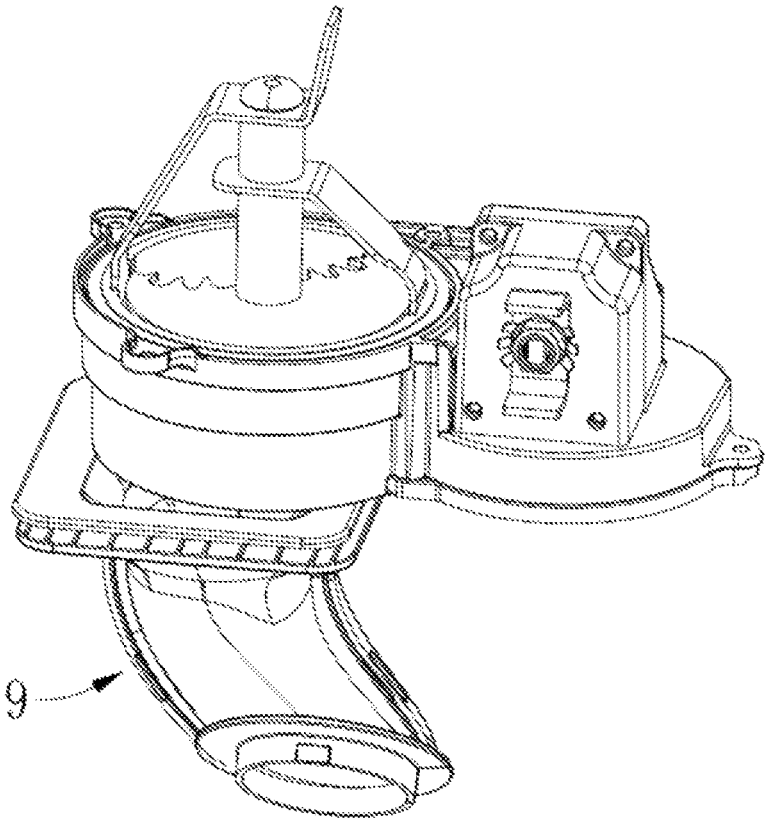
FIG. 10 is a schematic assembly view of an ice crushing device according to another embodiment of the present invention.
Figure 11:
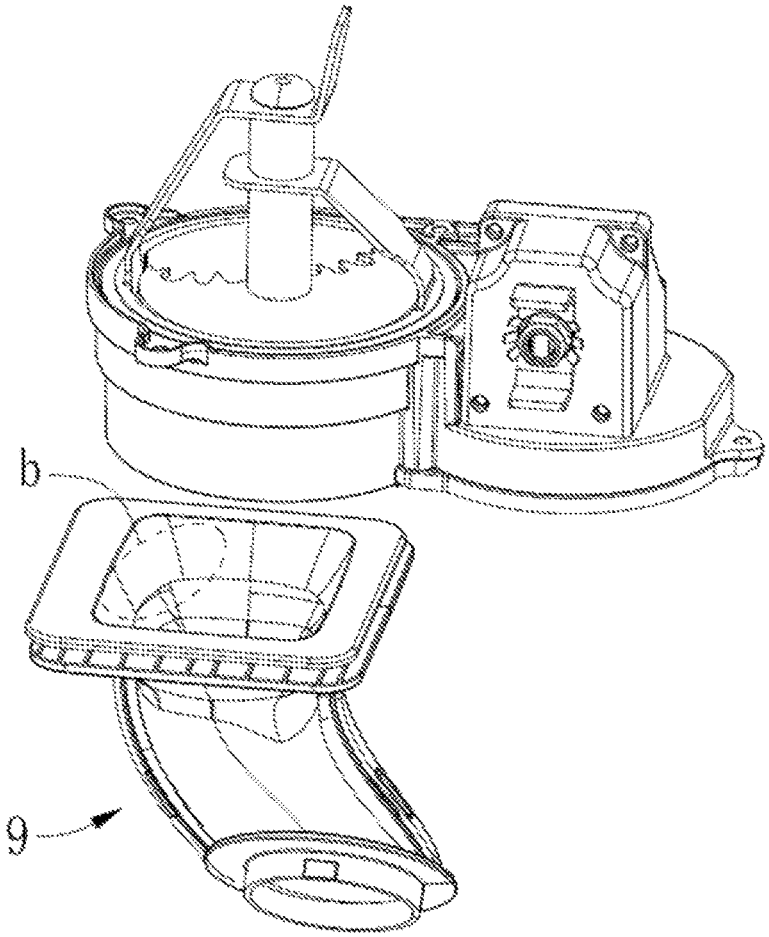
FIG. 11 is a schematic disassembly view of the structure shown in FIG. 10.
Figure 12:
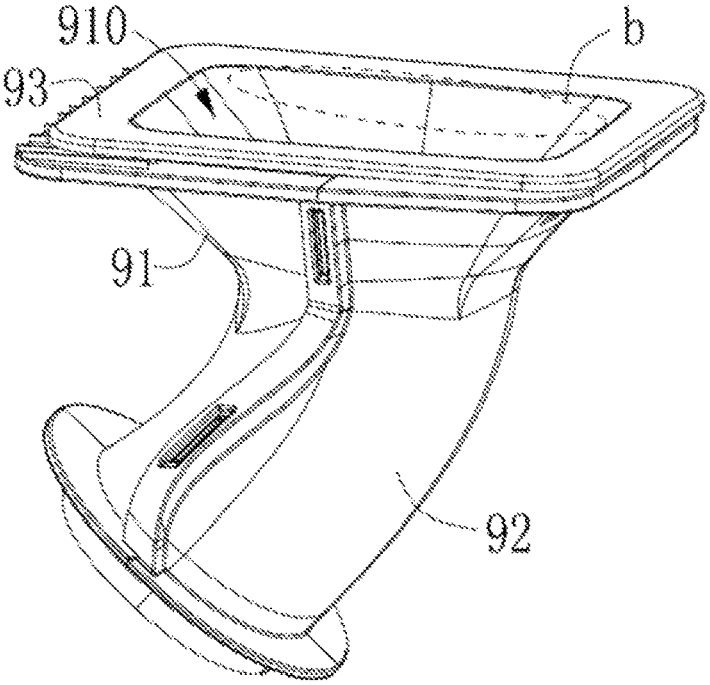
FIG. 12 is a schematic view of a first perspective of an ice exiting channel.
Figure 13:
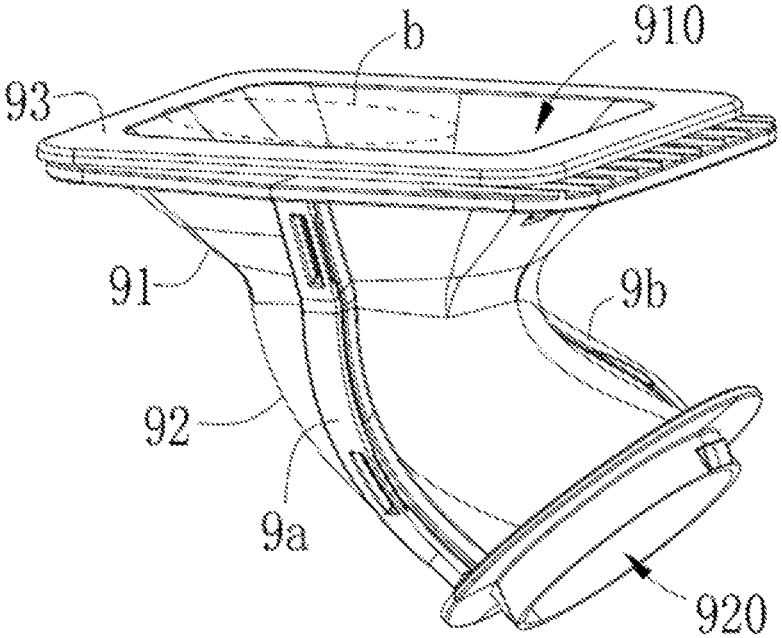
FIG. 13 is a schematic view of a second perspective of the ice exiting channel.

Referring to FIG. 10 and FIG. 11, in another embodiment, the ice crushing device provided by the present invention is further provided with an ice exiting channel 9 located below the ice outlet 10. With reference to FIG. 12 and FIG. 13, the ice exiting channel 9 includes a funneled ice receiving portion 91 and a pipeline portion 92 communicated with the lower end of the ice receiving portion 91. A channel inlet 910 butted with the ice outlet 10 is formed in the top end of the ice receiving portion 91. In particular, the channel inlet 910 is formed in the end, with a bigger opening area, of the funneled ice receiving portion 91. The lower end of the ice receiving portion 91 spirally extends downwards to form the pipeline portion 92. A channel outlet 920 for discharging the ice cubes in the ice exiting channel 9 is formed in the end, away from the ice receiving portion 91, of the pipeline portion 92.

In order to reduce an impact force, produced when the ice cubes discharged from the ice outlet 10 enter the ice exiting channel 9, on an inner wall of the ice exiting channel 9 to reduce the damage probability of the ice exiting channel 9 impacted by the ice cubes and noise generated when the ice crushing device discharges ice, the ice crushing device involved in the present invention is configured as below.

Figure 14:
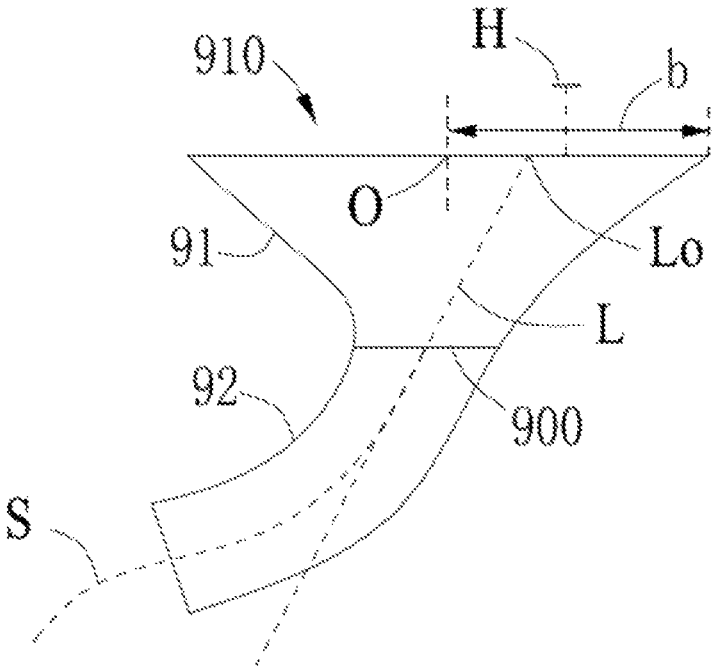
FIG. 14 is a schematic configuration view of disposing an ice outlet and the ice exiting channel.

In particular, referring to FIG. 14, the ice receiving portion 91 and the pipeline portion 92 have a joint marked with 900, a spiral trend line S in the center of the pipeline portion 92 has a tangent line L at the joint marked with 900. The tangent line L and a plane where the channel inlet 910 is located intersect at the right side of the center O of the channel inlet 910. The region at the right side is marked as a first side b. The tangent line L and the plane where the channel inlet 910 is located intersect at Lo. In order to achieve the effect described above, a projection of the geometric gravity center H of the ice outlet 10 on the plane where the channel inlet 910 is located falls within the range of the channel inlet 910 and is shifted toward the first side b.

Based on the above settings, a relatively safer distance is kept between the channel outlet 920 and the ice outlet 10, which reduces the probability that a user or a child accidentally stretches a hand into the ice outlet 10 through the ice exiting channel 9 and the hand is injured by the ice cutter component as a result.

Figure 15:
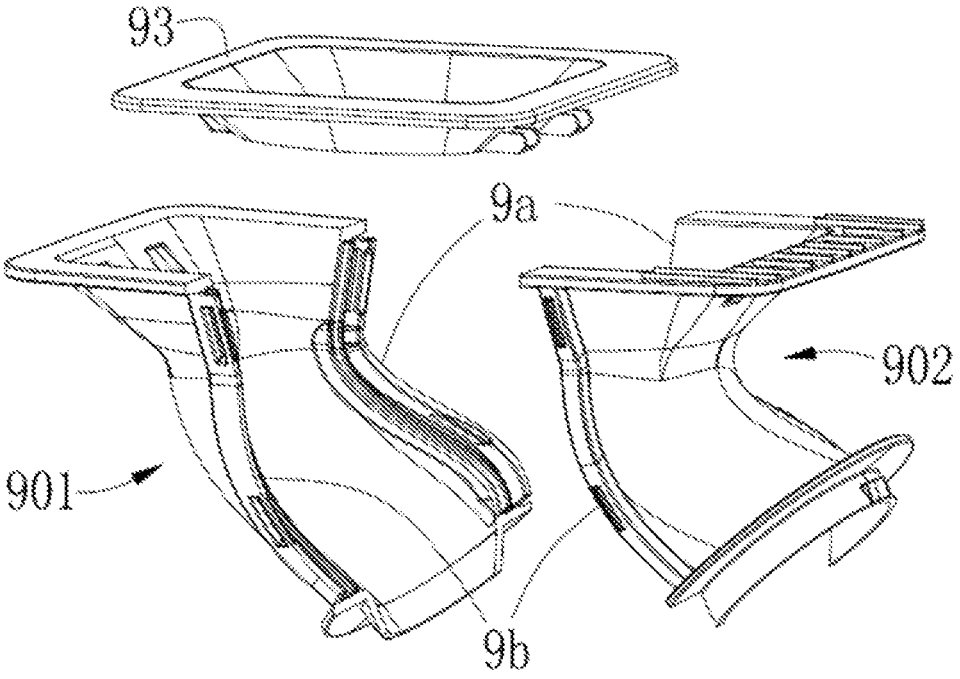
FIG. 15 is a schematic exploded view of FIG. 13.
Figure 16:
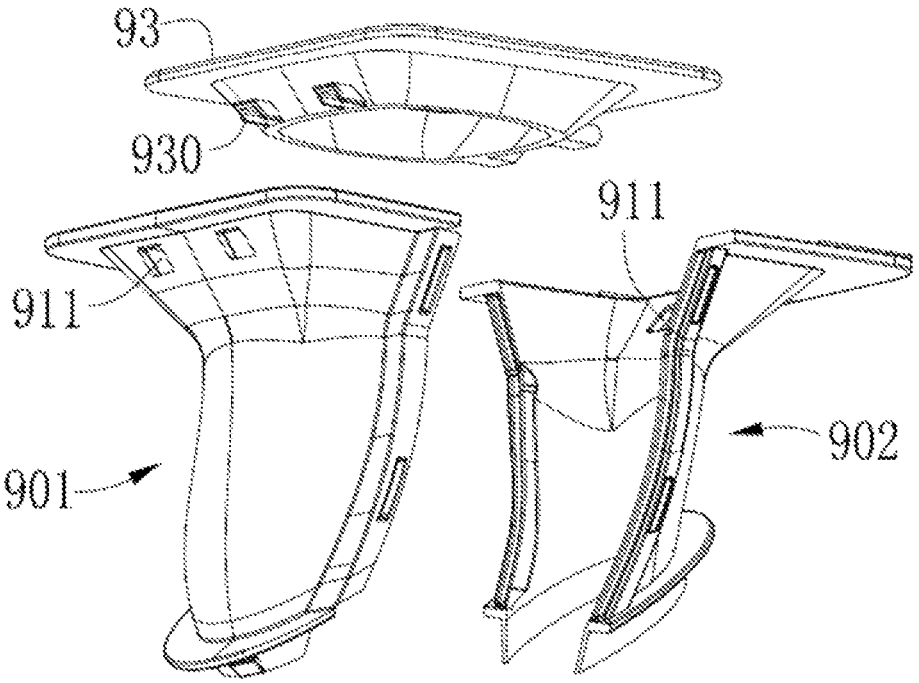
FIG. 16 is a schematic view of another perspective of FIG. 15.

During specific implementation, referring to FIG. 15, the ice exiting channel 9 includes a first housing 901 and a second housing 902 which are separately detachable. Two pairs of assembly edges that are fastened to be assembled to form the ice exiting channel 9 are disposed between the first housing 901 and the second housing 902. As shown, one pair of assembly edges **9*a* can be fastened for connection and fixation. The pair of assembly edges 9*a* is fastened and assembled by buckle structures disposed on the two assembly edges. Referring to some conventional designs for the specific structures of the buckles, which will not be described in detail herein. Assembly edges 9*b* are assembled in the same way as the assembly edges 9*a***.

In the present embodiment, the assembly edges **9*a* and 9*b* extend in a direction from an edge of the channel inlet 910 to an edge of the channel outlet 920. The method that two separated parts are assembled to form the ice exiting channel 9 is simpler in process. In other words, the ice exiting channel 9 is always formed by injection molding, and the manufacturing difficulty in integral forming is relatively higher. Certainly, in other embodiments of the present invention, integral forming of the ice exiting channel 9** is allowed.

According to the embodiment in the figure, in order to further reduce damage to the ice exiting channel 9 during discharge of the ice cubes and to prolong the service life of the ice exiting channel 9, with reference to FIG. 12, FIG. 13, FIG. 15 and FIG. 16, the ice exiting channel 9 is further provided with a funneled ice-receiving inner cover 93, which is through up and down and is integrally formed. The ice-receiving inner cover 93 is embedded into the ice receiving portion 91 and matches an inner wall of the ice receiving portion 91.

For the whole ice exiting channel 9, the most vulnerable position is a region under the ice outlet 10 of the ice crushing device. By adding the ice-receiving inner cover 93, the following advantage is achieved: the maintenance cost of the damaged ice exiting channel 9 is lowered. In particular, based on the configured shape and size, the manufacturing cost of the ice-receiving inner cover 93 is relatively lower than those of the first housing 901 and the second housing 902. A side wall of the ice-receiving inner cover 93 disposed in the ice receiving portion 91 is located under the ice outlet 10 of the ice crushing device and configured to directly bear impact from the ice cubes discharged from the ice outlet 10, such that the ice cubes can be prevented from directly impacting the ice receiving portion 91. Thus, the most vulnerable part of the ice exiting channel 9 of the ice crushing device is the ice-receiving inner cover 93 but not the first housing 901 or the second housing 902. Therefore, after the ice exiting channel 9 is damaged, the only requirement is to replace the ice-receiving inner cover 93. Hence, the maintenance cost can be effectively lowered.

In order to facilitate assembly, the ice-receiving inner cover 93 is secured to the first housing 901 and the second housing 902 by means of fastening. In particular, referring to FIG. 16, at least one through hole 911 is formed in the position, corresponding to the ice receiving portion 91, of each of the first housing 901 and the second housing 902. In the present embodiment, two through holes 911 are formed in the ice receiving portion 91 of the first housing 901 and two through holes 911 are also formed in the ice receiving portion 91 of the second housing 902. The two through holes 911 in the first housing 901 and the two through holes 911 in the second housing 902 are opposite to each other. An outer wall of the ice-receiving inner cover 93 protrudes and extends outwards to form a bulge 930 capable of being embedded into the through holes 911. In the specific embodiment, two bulges 930 are disposed on an outer wall of each of two opposite sides of the ice-receiving inner cover 93. The bulges 930 are embedded into the through holes 911 to secure the ice-receiving inner cover 93 to the inner side of the ice receiving portion 91. Fastening through the self structure without other fixing structures, for example screws, is convenient and simple and can improve the assembly efficiency.

It should be understood that, although the description is described in terms of embodiments, each embodiment is not intended to be construed as an independent technical solution. The narration mode of the description is merely for the sake of clarity. Those skilled in the art should take the description as a whole. The technical solutions in the embodiments may also be combined as appropriate to form other embodiments that can be understood by those skilled in the art.

The series of detailed descriptions set forth above are merely illustrative of the feasible embodiments of the present invention, and are not intended to limit the scope of protection of the present invention. Any equivalent embodiments or modifications that do not depart from the art spirit of the present invention should be included within the scope of protection of the present invention.

What is claimed is:

1. An ice crushing device, comprising a shaft seat with an ice outlet formed in the bottom, a fixed shaft fixedly disposed on the shaft seat, a drum rotationally disposed on the shaft seat by taking the fixed shaft as a rotation axis and an ice-incoming baffle plate disposed at a top of the drum, wherein an ice cutter component is disposed inside the drum, and comprises at least one fixed ice cutter secured to the fixed shaft and at least one rotary ice cutter secured to an inner wall of the drum and capable of rotating with the drum; the rotary ice cutter has a first rotation direction for rotation relative to the fixed ice cutter to cut a whole piece of ice in the drum into crushed ice; the ice outlet is located at one side of the fixed shaft and provided with a crushed-ice discharge side for discharging the crushed ice; when rotating in the first rotation direction, the rotary ice cutter enters a space at an upper portion of the ice outlet from a position right above the crushed-ice discharge side of the ice outlet; the fixed ice cutter is located in a space at the upper portion of the ice outlet and provided with a cutter edge side for cutting the whole piece of ice; and the cutter edge side of the fixed ice cutter faces the crushed-ice discharge side;

the ice-incoming baffle plate is secured to the fixed shaft and provided with an ice inlet that allows the whole piece of ice at the top of the drum to enter the drum, the ice inlet is located at one side of the fixed shaft, and the ice inlet and the ice outlet are mutually staggered in the first rotation direction; a first side edge and a second side edge of the ice inlet are respectively defined at two opposite inlet edges of the ice inlet in view of the first rotation direction, the first side edge and the second side edge are respectively equipped with saw-toothed structures to cut the whole piece of ice located in the ice inlet into crushed ice in response to rotation of the drum relative to the ice-incoming baffle plate in the first rotation direction.

2. The ice crushing device according to claim 1, wherein the rotary ice cutter further has a second rotation direction, which is opposite to the first rotation direction and allows the whole piece of ice to be directly pushed into the ice outlet; the ice outlet is provided with a whole-piece-of-ice discharge side; when rotating in the second rotation direction, the rotary ice cutter enters the space at the upper portion of the ice outlet from a position right above the whole-piece-of-ice discharge side of the ice outlet; and a distance between a side, away from the cutter edge side, of the fixed ice cutter and the whole-piece-of-ice discharge side is larger than the size of the whole piece of ice.

3. The ice crushing device according to claim 2, wherein the ice outlet takes the shape of a sector, the center of a circle where the sector is located is positioned at the fixed shaft, and the crushed-ice discharge side and the whole-piece-of-ice discharge side respectively constitute two radiuses of a central angle of the sector.

4. The ice crushing device according to claim 1, wherein the rotary ice cutter and the fixed ice cutter which constitute the ice cutter component are staggered along the fixed shaft from top to bottom.

5. The ice crushing device according to claim 4, wherein one fixed ice cutter is disposed at a lowermost end of the ice cutter component, and a distance between the cutter edge side of the fixed ice cutter at the lowermost end and the crushed-ice discharge side is smaller than the size of the whole piece of ice.

6. The ice crushing device according to claim 4, wherein the ice cutter component is provided with at least two fixed ice cutters, all the fixed ice cutters are laminated and spaced in a vertical direction, and a distance between the two adjacent fixed ice cutters in the vertical direction is smaller than the size of the whole piece of ice.

7. The ice crushing device according to claim 1, wherein one rotary ice cutter is disposed at an uppermost layer of the ice cutter component.

8. The ice crushing device according to claim 1, wherein the size of an overlap of projections of the ice inlet and the ice outlet in a vertical direction is smaller than the size of the whole piece of ice.

9. The ice crushing device according to claim 1, wherein the rotary ice cutter is provided with a cutter edge side for cutting the whole piece of ice; in the first rotation direction, the cutter edge side of the rotary ice cutter is located on a front side of the rotary ice cutter; and when the rotary ice cutter rotates in the first rotation direction, the cutter edge sides of the rotary ice cutter and the fixed ice cutter perform a cutting motion relative to each other.

10. The ice crushing device according to claim 9, wherein the cutter edge sides of the rotary ice cutter and the fixed ice cutter are designed into saw-toothed structures.

11. The ice crushing device according to claim 9, wherein a first rotation hole is formed in the rotary ice cutter, the rotary ice cutter is rotationally disposed on the fixed shaft through the first rotation hole, and two ends of the rotary ice cutter are secured to the inner wall of the drum.

12. The ice crushing device according to claim 1, further provided with an ice exiting channel located below the ice outlet, wherein the ice exiting channel comprises a funneled ice receiving portion and a pipeline portion communicated with a lower end of the ice receiving portion; a channel inlet butted with the ice outlet is formed in a top end of the ice receiving portion; the lower end of the ice receiving portion spirally extends downwards to form the pipeline portion; a tangent line of a spiral trend line in the center of the pipeline portion at a joint of the ice receiving portion and the pipeline portion and a plane where the channel inlet is located intersect at a first side in the center of the channel inlet; and a projection of a geometric gravity center of the ice outlet on the plane where the channel inlet is located falls within the range of the channel inlet and is shifted toward the first side.

13. The ice crushing device according to claim 12, wherein the ice exiting channel includes a first housing and a second housing which are separately detachable, two pairs of assembly edges that are fastened to be assembled to form the ice exiting channel are disposed between the first housing and the second housing, the assembly edges and extend in a direction from an edge of the channel inlet to an edge of the channel outlet, the ice exiting channel is further provided with a funneled ice-receiving inner cover, the ice-receiving inner cover is embedded into the ice receiving portion and matches an inner wall of the ice receiving portion.

14. The ice crushing device according to claim 13, wherein two through holes are formed in the ice receiving portion of the first housing and two through holes are also formed in the ice receiving portion of the second housing, an outer wall of the ice-receiving inner cover protrudes and extends outwards to form a bulge being embedded into the through holes, the bulge is embedded into the through holes to secure the ice-receiving inner cover to the inner side of the ice receiving portion.

15. The ice crushing device according to claim 1, wherein the shaft seat includes a shaft seat bottom disposed at the bottom of the shaft seat and a drum shell extending upwards from a periphery of the shaft seat bottom, the drum is embedded into the drum shell, the drum is driven by a motor, a round of engaging teeth are formed in a peripheral side wall of the drum, a direct-driven gear engages with the engaging teeth to drive the drum to rotate, a gear component constituted of a plurality of gears is further disposed between the motor and the direct-driven gear, the direct-driven gear is secured to a rotating shaft base, a gear housing configured to encapsulate the direct-driven gear and the gear component is disposed on the rotating shaft base, a notch that allows the direct-driven gear to cooperate with the engaging teeth is formed between the gear housing and the drum shell, the gear housing and the drum shell are integrally formed.

16. The ice crushing device according to claim 1, wherein an ice stirring mechanism that rotates synchronously with the drum to stir the ice cubes at the top of the drum is disposed at the top of the drum, the ice stirring mechanism includes a plurality of ice stirring pieces, each of which is provided with a fixed portion secured to the drum and a second rotation hole for rotation around the fixed shaft.

17. An ice crushing device, comprising a shaft seat with an ice outlet formed in the bottom, a fixed shaft fixedly disposed on the shaft seat, a drum rotationally disposed on the shaft seat by taking the fixed shaft as a rotation axis and an ice-incoming baffle plate is disposed at the top of the drum, wherein an ice cutter component is disposed inside the drum, and comprises at least one fixed ice cutter secured to the fixed shaft and at least one rotary ice cutter secured to an inner wall of the drum and capable of rotating with the drum; the rotary ice cutter has a first rotation direction for rotation relative to the fixed ice cutter to cut a whole piece of ice in the drum into crushed ice; the ice outlet is located at one side of the fixed shaft and provided with a crushed-ice discharge side for discharging the crushed ice; when rotating in the first rotation direction, the rotary ice cutter enters a space at an upper portion of the ice outlet from a position right above the crushed-ice discharge side of the ice outlet; the fixed ice cutter is located in a space at the upper portion of the ice outlet and provided with a cutter edge side for cutting the whole piece of ice; and the cutter edge side of the fixed ice cutter faces the crushed-ice discharge side;

the ice crushing device further comprises an ice exiting channel located below the ice outlet, the ice exiting channel comprises a funneled ice receiving portion and a pipeline portion communicated with a lower end of the ice receiving portion; the ice exiting channel includes a first housing and a second housing which are separately detachable, two pairs of assembly edges that are fastened to be assembled to form the ice exiting channel are disposed between the first housing and the second housing, and respectively extend in a direction from an edge of a channel inlet of the ice exiting channel to an edge of a channel outlet of the ice exiting channel, the ice exiting channel is further provided with a funneled ice-receiving inner cover, the ice-receiving inner cover is embedded into the ice receiving portion and matches an inner wall of the ice receiving portion.

18. The ice crushing device according to claim 17, wherein two through holes are formed in the ice receiving portion of the first housing and two through holes are also formed in the ice receiving portion of the second housing, an outer wall of the ice-receiving inner cover protrudes and extends outwards to form a bulge being embedded into the through holes, the bulge is embedded into the through holes to secure the ice-receiving inner cover to the inner side of the ice receiving portion.

* * * * *